US010527272B2

(12) United States Patent
Layne et al.

(10) Patent No.: US 10,527,272 B2
(45) Date of Patent: Jan. 7, 2020

(54) LOW PROFILE ADAPTER FOR RECESSED TRACK

(71) Applicant: ABL IP Holding LLC, Decatur, GA (US)

(72) Inventors: Bruce Layne, Wheaton, IL (US); James G. Brand, Schaumburg, IL (US)

(73) Assignee: ABL IP Holding LLC, Atlanta, GA (US)

( * ) Notice: Subject to any disclaimer, the term of this patent is extended or adjusted under 35 U.S.C. 154(b) by 125 days.

(21) Appl. No.: 15/450,500

(22) Filed: Mar. 6, 2017

(65) Prior Publication Data

US 2018/0252393 A1 Sep. 6, 2018

(51) Int. Cl.
*F21V 23/06* (2006.01)

(52) U.S. Cl.
CPC ..... *F21V 23/06* (2013.01)

(58) Field of Classification Search
CPC ..... F21V 21/005; F21V 21/14; F21V 23/06; F21V 21/35; F21V 21/002; F21S 8/06
USPC ..... 362/396
See application file for complete search history.

(56) References Cited

U.S. PATENT DOCUMENTS 3,503,032 A 3/1970 Routh et al.
3,737,834 A 6/1973 Contratto
3,832,503 A 8/1974 Crane
3,963,294 A * 6/1976 Heritage ..... F21V 21/02 439/121
4,032,208 A 6/1977 Berkenhoff
4,190,309 A 2/1980 Glass
4,414,617 A 11/1983 Galindo
4,533,190 A 8/1985 Booty
4,699,439 A 10/1987 Cohen
4,822,292 A * 4/1989 Thayer ..... H01R 25/142 439/115
4,975,071 A 12/1990 Bedocs et al.
2002/0045369 A1* 4/2002 Agro ..... F21S 8/06 439/121

FOREIGN PATENT DOCUMENTS

WO 2011124601 10/2011

OTHER PUBLICATIONS

Contech Lighting, Lightolier Track Adapter, Retrieved from: http://www.contechlighting.com/product/la10251, 2017.
Cree LED Lighting, Essentia® by Cree Track, Retrieved from: http://lighting.cree.com/products/indoor/track/essentia-by-cree-track, 2016.

(Continued)

*Primary Examiner* — Anh T Mai
*Assistant Examiner* — Glenn D Zimmerman
(74) *Attorney, Agent, or Firm* — Kilpatrick Townsend & Stockton LLP

(57) ABSTRACT

An adapter for mounting a luminaire to a track of a track lighting system includes a main body and a head having axes that are angled with respect to each other. The head is configured to be insertable into the track and rotatable to align the adapter body with the track ant to make electrical contact with conductors within the track. The rotation required is less than 70 degrees, and may be as little as 13 degrees or less, enabling installation of track lighting near obstructions.

18 Claims, 7 Drawing Sheets

(56) References Cited

OTHER PUBLICATIONS

Eurofase Lighting, Eurofase Lighting, Retrieved from: internet archive wayback machine—http://www.eurofase.com/products/tracks, 2017.
First Light, Nordic Global GAC600-3 3f Pulse railadaptor wit, Retrieved from: https://www.firstlight.nl/spanningsrail/spanningsrail-3-fase/nordic-global-trac-pulse-3-fase-opbouw-wit/nordic-global-gac600-3-3f-pulse-railadaptor-wit/, 2017.
Progress Lighting, Assembly & Installation Instructions, Apr. 17, 2009, (4 pages).
CA 2,994,268 , "Office Action", dated Apr. 30, 2019, 6 pages.

* cited by examiner

LOW PROFILE ADAPTER FOR RECESSED TRACK

BACKGROUND OF THE INVENTION

Track lighting is used in various residential and commercial lighting applications, and provides adaptability to different lighting needs. In a typical track lighting installation, a channel or track is mounted on a ceiling. The track is generally "C" shaped, and contains a pair of electrical conductors disposed lengthwise inside and along the length of the track. Luminaires can be connected at nearly any position along the length of the track, drawing their power from the conductors in the track. The conductors within the track need only be connected to a source of power at one location along the track, for example at one end.

Typically, an adapter is used to make the connection between the luminaire and the track. Each luminaire is attached to an adapter, which in turn is mounted to the track. The adapter has features for being captured within the C-shaped track and features to which the luminaire can be attached, to provide mechanical support to the luminaire. The adapter also includes contacts for making an electrical connection between the luminaire and the conductors within the track. In this way, a wide variety of luminaires may be used with only one style or a small number of styles of adapters.

To install the adapter to the track, typically the adapter is oriented so that part of it can be inserted within the open side of the C-shaped track, and then the adapter is turned—typically 90 degrees—about a vertical axis, so that part of the adapter is captured within the track and the contacts engage the conductors within the track.

In some installations, for example when a large luminaire is being installed near a wall or other obstruction or when large luminaires are being installed near each other, the 90-degree rotation may make installation difficult because the luminaires may interfere with the obstruction or each other during the installation process.

SUMMARY OF THE INVENTION

According to one aspect, an adapter for mounting a luminaire to a track of a track lighting system comprises a main body having a first side configured to be installed toward the track. The main body has a longitudinal axis and a width measured transverse to the longitudinal axis of the main body. The main body also has a second side opposite the first, the second side including a feature for attachment of a luminaire. The adapter further comprises a head extending from the first side of the main body. The head has a longitudinal axis and a width measured transverse to the longitudinal axis of the head. The width of the head is smaller than the width of the main body and the head is of a shape and size to be inserted into the track when the longitudinal axis of the head is parallel to the track. The longitudinal axis of the head is angled by less than 70 degrees with respect to the longitudinal axis of the main body. The adapter further comprises two hook features on the head positioned to engage the track when the adapter is installed to the track with the longitudinal axis of the main body parallel to the track. The adapter further comprises two electrical contacts extending from the head. The contacts are of a shape and size to contact conductors in the track when the adapter is installed to the track with the longitudinal axis of the main body parallel to the track. In some embodiments, the track is included with the adapter. In some embodiments, a luminaire mounted to the adapter is included. In some embodiments, the adapter is installable to the track by inserting the head into the track with the longitudinal axis of the head parallel to the track and subsequently turning the adapter such that the longitudinal axis of the main body is parallel to the track, and the adapter further comprises a deflectable latch that engages the track to hold the longitudinal axis of the main body parallel to the track after installation. In some embodiments, the latch is integrally formed with a housing of the adapter, and is deflectable at least in part by virtue of the flexibility of the material of the housing and latch. In some embodiments, the main body and the head are formed from two pieces that fit together in a clamshell fashion and snap together, capturing the two electrical contacts. In some embodiments, the adapter further comprises a pivot bushing installed at the second side of the adapter, the pivot bushing being captured by the two pieces. In some embodiments, the pivot bushing is prevented by the two pieces from rotation with respect to the main body. In some embodiments, the longitudinal axis of the head is angled by less than 45 degrees with respect to the longitudinal axis of the main body. In some embodiments, the longitudinal axis of the head is angled by less than 30 degrees with respect to the longitudinal axis of the main body. In some embodiments, the longitudinal axis of the head is angled by less than 15 degrees with respect to the longitudinal axis of the main body.

According to another aspect, a method of installing an adapter to a track in a track lighting system comprises providing an adapter. The adapter comprising 1) a main body having a first side configured to be installed toward the track, the main body having a longitudinal axis and a width measured transverse to the longitudinal axis of the main body, the main body also having a second side opposite the first, the second side including a feature for attachment of a luminaire; 2) a head extending from the first side of the main body, the head having a longitudinal axis and a width measured transverse to the longitudinal axis of the head, wherein the width of the head is smaller than the width of the main body; 3) two hook features on the head; and 4) two electrical contacts extending from the head. The method further comprises aligning the longitudinal axis of the head parallel to the track, inserting the head into the track, and rotating the adapter less than 70 degrees to bring the longitudinal axis of the main body into parallelism with the track, at the same time bringing the hook features into engagement with the track and the electrical contacts into contact with conductors in the track. In some embodiments, the method further comprises deflecting a latch before rotating the adapter to bring the longitudinal axis of the main body into parallelism with the track. In some embodiments, the adapter is rotated less than 45 degrees to bring the longitudinal axis of the main body into parallelism with the track. In some embodiments, the adapter is rotated less than 30 degrees to bring the longitudinal axis of the main body into parallelism with the track. In some embodiments, the adapter is rotated less than 15 degrees to bring the longitudinal axis of the main body into parallelism with the track.

According to another aspect, a track lighting system comprises a track having a generally C-shaped cross section and two ledges extending inward from two outer sides of the track, the track supporting two conductors in the track, and the track lighting system also comprises an adapter. The adapter comprises a main body having a first side configured to be installed toward the track, the main body having a longitudinal axis and a width measured transverse to the longitudinal axis of the main body, the main body also having a second side opposite the first, the second side including a feature for attachment of a luminaire. The adapter also comprises a head extending from the first side of the main body, the head having a longitudinal axis and a width measured transverse to the longitudinal axis of the head. The width of the head is smaller than the width of the main body and the head is of a shape and size to be inserted into the track when the longitudinal axis of the head is parallel to the track. The longitudinal axis of the head is angled by less than 70 degrees with respect to the longitudinal axis of the main body. The adapter further comprises two hook features on the head positioned to engage the ledges of the track when the adapter is installed to the track with the longitudinal axis of the main body parallel to the track. The adapter further comprises two electrical contacts extending from the head, the contacts being of a shape and size to contact conductors in the track when the adapter is installed to the track with the longitudinal axis of the main body parallel to the track. In some embodiments, the lighting system further comprises a luminaire attached to the adapter such that the luminaire is supported by the track and the adapter and draws power from the two conductors in the track. In some embodiments, each of the two hook features engages its respective ledge by at least 15 percent of the overall width of the track.

DETAILED DESCRIPTION OF THE DRAWINGS

Figure 1:
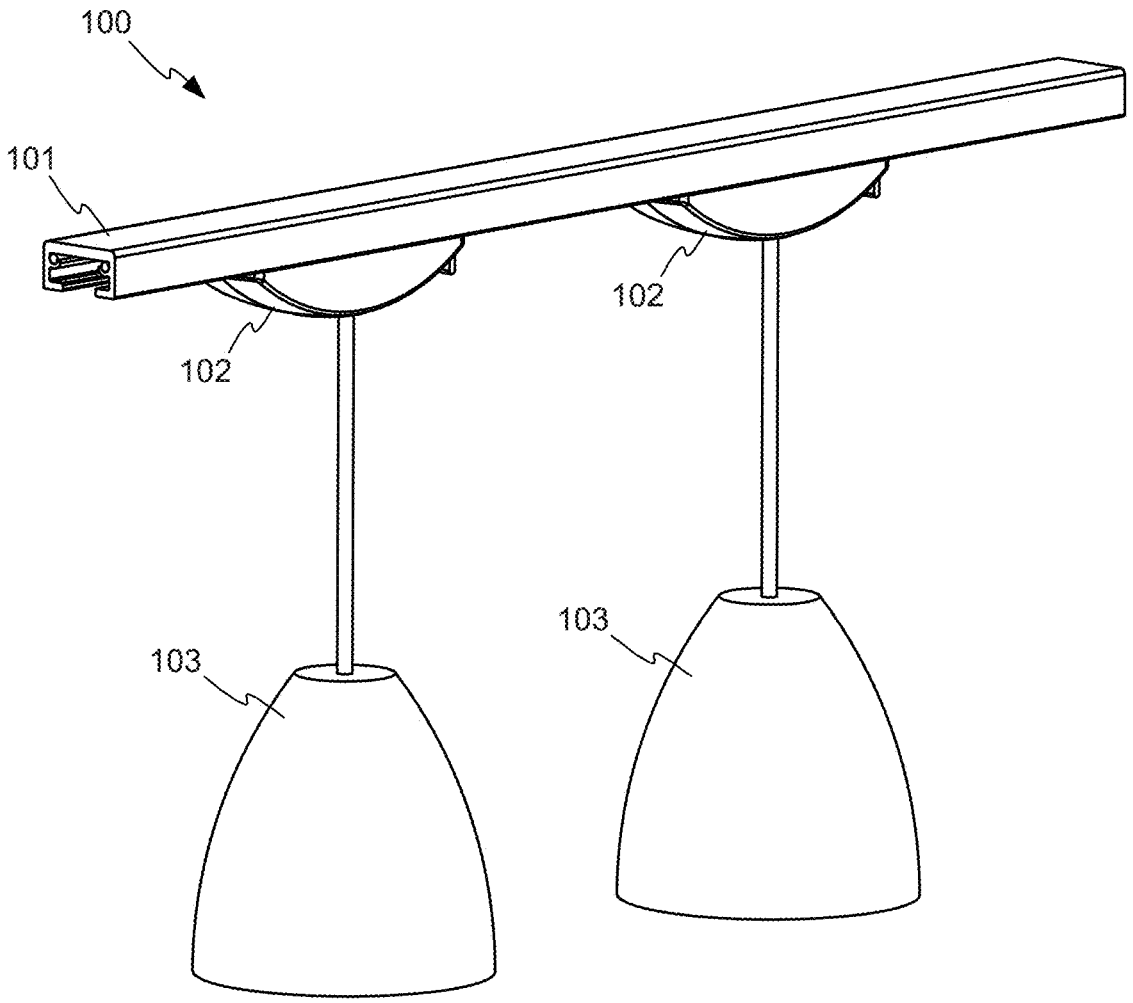
FIG. 1 illustrates a track lighting system in accordance with embodiments of the invention.

FIG. 1 illustrates a track lighting system 100 in accordance with embodiments of the invention. The track lighting system 100 includes a track 101, described in more detail below. Two adapters 102 are attached to the track 101, and two luminaires 103 are attached respectively to the adapters 102. While the example of FIG. 1 uses simple pendant lights as the luminaires 103, other embodiments may use a wide variety of luminaires, including luminaires that can tilt and swivel to provide adjustability in the direction of light produced by the lighting system 100, or any other suitable kind of luminaire.

Figure 2:
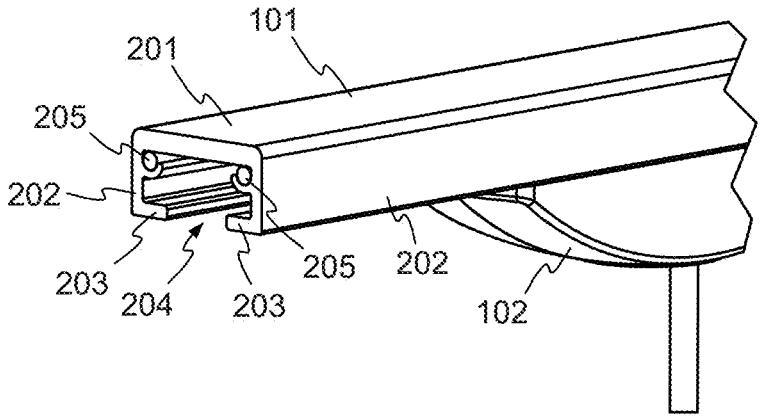
FIG. 2 illustrates the track of FIG. 1 in more detail.

FIG. 2 illustrates the track 101 in more detail. In FIGS. 1 and 2, no end cap is shown so that the interior of the track 101 is visible. In an actual completed installation, a protective or decorative end cap may be place over the end of the track 101.

The track 101 has a back face 201 and two sides 202. The two sides 202 support ledges 203, leaving a gap 204 between the ledges 203. Two electrical conductors 205 are mounted in the upper corners of the track 101. At some point along the track 101, the conductors 205 will be connected to a source of power using a fitting designed for that purpose. The conductors 205 thus form a power bus along the length of the track 101. The conductors may be, for example, stranded or solid copper or aluminum conductors, or any other suitable kind of conductors that preferably meet all applicable building codes. In some installations, the source of power may be the mains, which typically provide power at 110 volts AC in the United States. In other installations, the source of power may be a low voltage supply, for example producing 12 or 24 volts DC. The invention is not limited by the nature of the power provided to the conductors 205.

Figure 3:
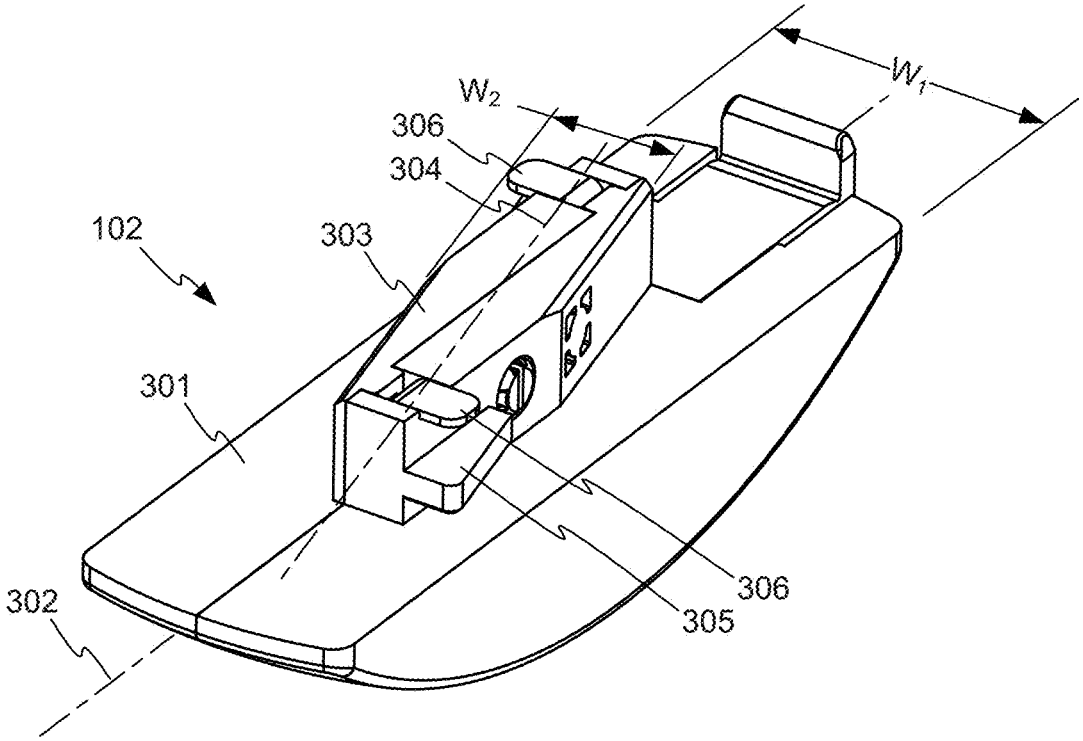
FIG. 3 shows an upper oblique view of an adapter in accordance with embodiments of the invention.
Figure 4:
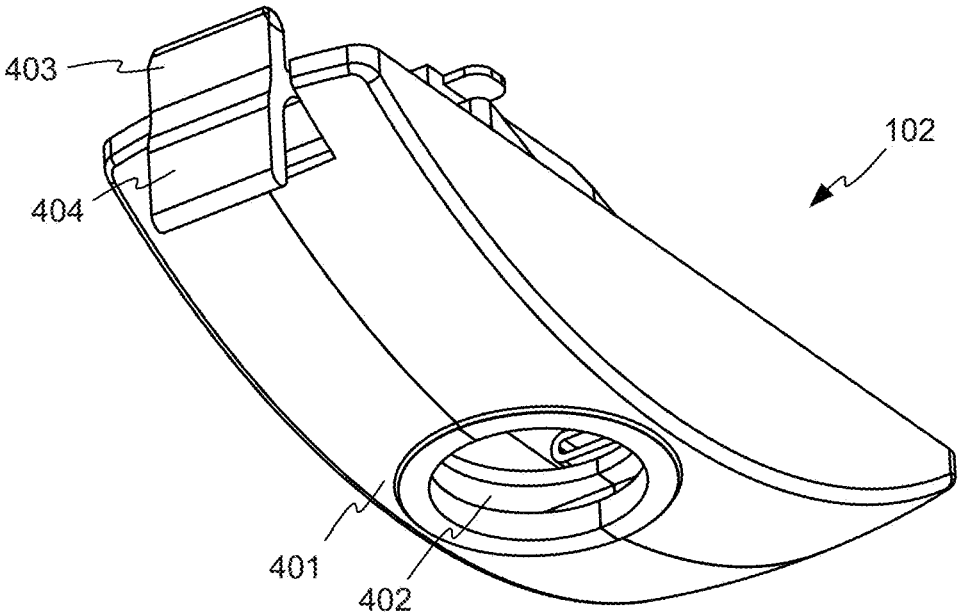
FIG. 4 shows a lower oblique view of the adapter of FIG. 3, in accordance with embodiments of the invention.

FIG. 3 shows an upper oblique view of the adapter 102 in accordance with embodiments of the invention, and FIG. 4 shows a lower oblique view of the adapter 102. As shown in FIGS. 3 and 4, the adapter 102 has an upper face 301 configured to be installed toward the track 101. The adapter 102 has longitudinal axis 302, and the width $W_1$ of the adapter is measured transversely to the longitudinal axis. Once the adapter 102 is installed in a track, the longitudinal axis 302 will preferably be parallel to the long dimension of the track.

The adapter 102 also includes a head 303, having its own longitudinal axis 304 and a width $W_2$ measured transversely to the longitudinal axis 304 of the head 303. The width $W_2$ of the head 303 is smaller than the width $W_1$ of the adapter 102, and is sufficiently small that head 303 can be inserted into the gap 204 of the track 101 when the longitudinal axis 304 of the head 303 is parallel to the long dimension of the track 101.

The adapter 102 also includes two hook features 305 (only one of which is visible in FIG. 3) for engaging the track. Specifically, the hook features 305 engage the support ledges 203 of the track 101 when the longitudinal axis 302 of the adapter 102 is parallel to the track 101. This engagement is described in more detail below.

The adapter 102 further includes two electrical contacts 306 for engaging the conductors 205 within the track 101, as is described in more detail below.

As best seen in FIG. 4, the adapter 102 also has a second side 401 having a feature 402 for attaching a luminaire. A deflectable latch 403 is positioned to engage the sides of the gap 204 of the track 101, and includes a disengagement lever 404.

Figure 5:
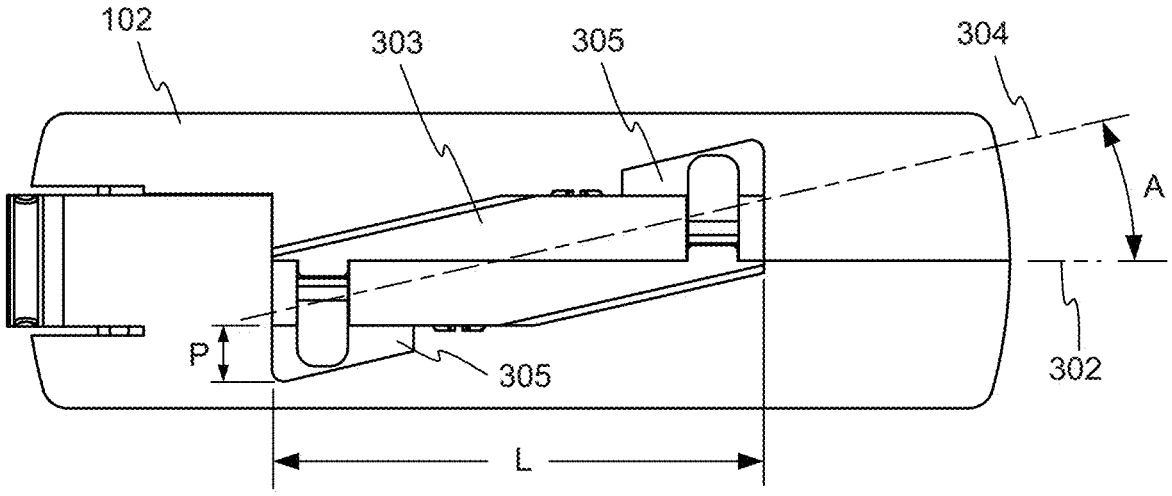
FIG. 5 shows the adapter of FIG. 3 in an orthogonal top view.

FIG. 5 shows the adapter 102 in an orthogonal top view. As can be seen in FIG. 5, the axis 302 of the adapter 102 and the axis 304 of the head 303 make an angle A. In the example embodiment shown, angle A is 13 degrees. Thus, when installing the adapter 102 into the track 101, the adapter 102 need only be rotated 13 degrees once the head 303 is within the track 101, in order to bring the adapter 102 parallel with the track 101.

As is also visible in FIG. 5, the head 303 has a length L sufficient that the hook features 305 protrude sufficiently far from the head 303 to provide substantial engagement with the ledges 203 of the track 101 when the adapter is installed in the track 101. For example, in the example shown, length L is about 1.25 inches, and each of the hook features 305 protrudes a distance P of about 0.15 inches from the face of the head 303 to which the hook feature 305 is attached. It will be recognized that the smaller the rotation angle A, the more difficult it may be to provide sufficient engagement with the ledges 203 of the track 101 to securely support the adapter 102. The protrusion distance P may be at least 10 percent of the overall width of the track 101, and may preferably be at least 15 percent of the overall width of the track 101, and more preferably at least 18 percent.

In other embodiments, the axes 302 and 304 of the adapter 102 and head 303 may make a different angle between them, for example 10, 15, 20, 25, 30, 40, 45, 50, or 60 degrees, but in any event less than 70 degrees.

Figure 6:
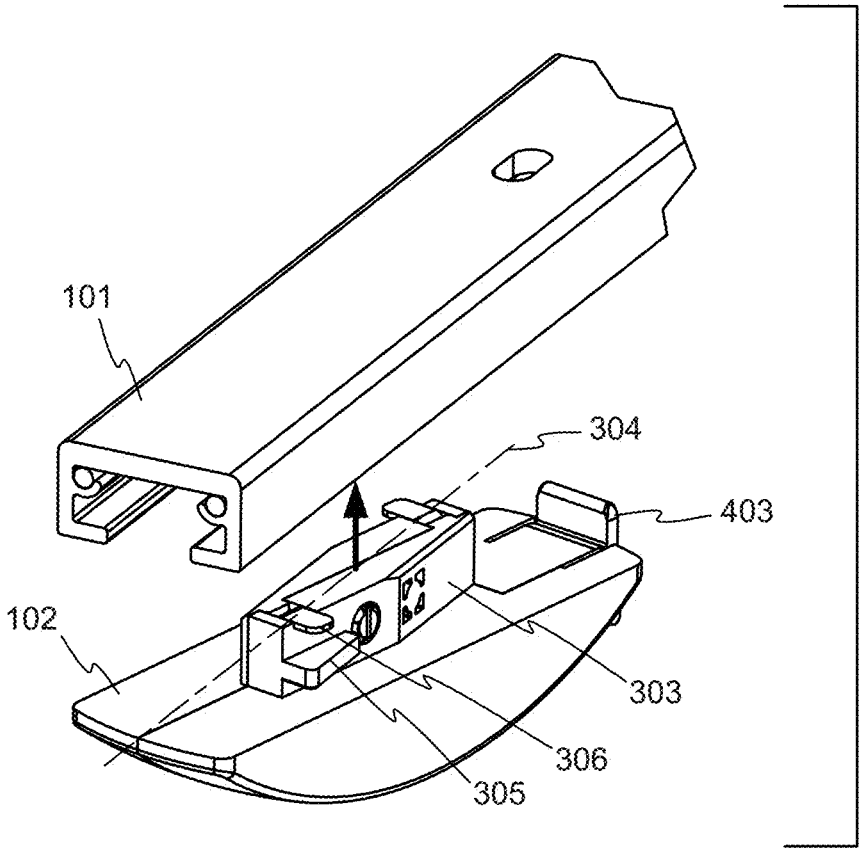
FIG. 6 shows the adapter of FIG. 3 positioned below the track, in accordance with embodiments of the invention.
Figure 7:
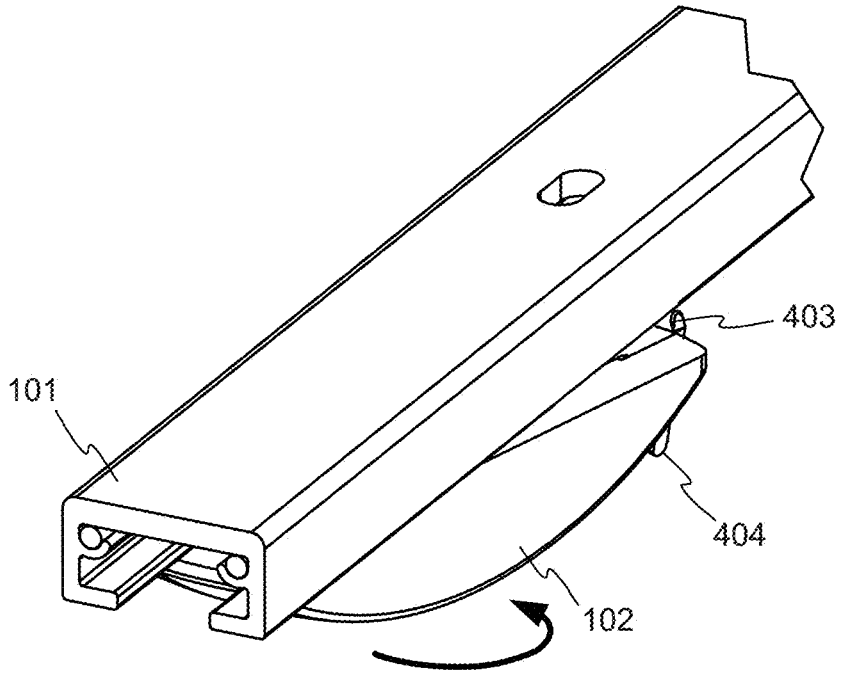
FIG. 7 shows the adapter of FIG. 3 with a portion of the adapter inserted into the track, in accordance with embodiments of the invention.
Figure 8:
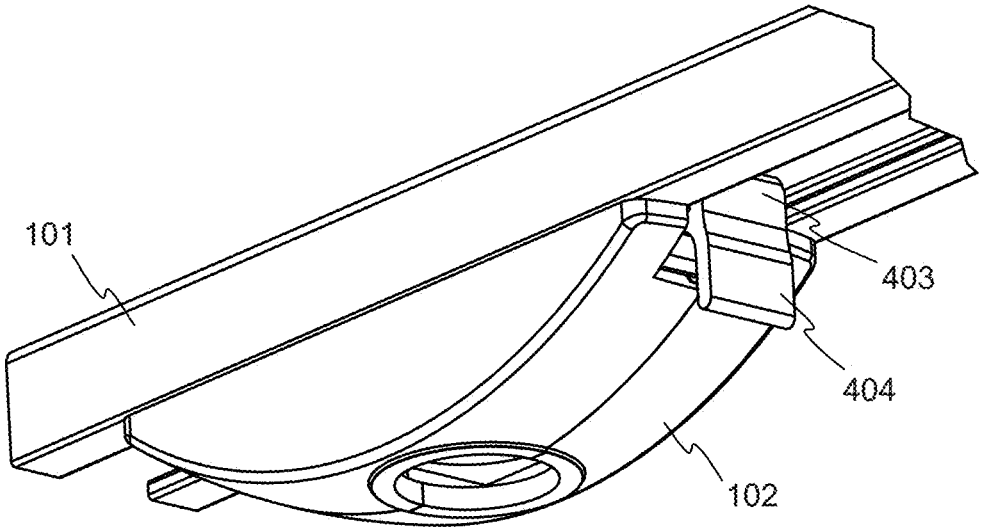
FIG. 8 shows the completed installation, in accordance with embodiments of the invention.

FIGS. 6-8 illustrate the process of installing the adapter 102 into the track 101. In FIG. 6, the adapter 102 has been positioned below the track 101, with the axis 304 of the head 303 parallel to the track 101. In this orientation, the adapter 102 can be raised toward the track 101 and the head 303 can be inserted into the track 101, including the hook features 305 and the contacts 306.

FIG. 7 shows the adapter 102 with the head 303 inserted into the track 101. The latch 403 has been deflected downward, either by actuation of disengagement lever 404 or by virtue of the adapter 102 being pushed upward against the track 101. Once in this position, the adapter 102 can be rotated into parallelism with the track 101, in the direction shown. FIG. 8 shows the completed installation. The deflectable latch 403 has rotated upward to engage the track 101, to hold the adapter 102 in parallel relationship with the track 101. The adapter 102 may be removed from the track 101 by the reverse of this process. The latch 403 can be deflected downward, for example by thumb pressure on the lever 404. With the latch 403 in the downward position and out of engagement with the track 101, the adapter 102 can be rotated so that the longitudinal axis 304 of the head 303 is parallel to the track, and the adapter 102 can be simply lowered away from the track 101.

Figure 9:
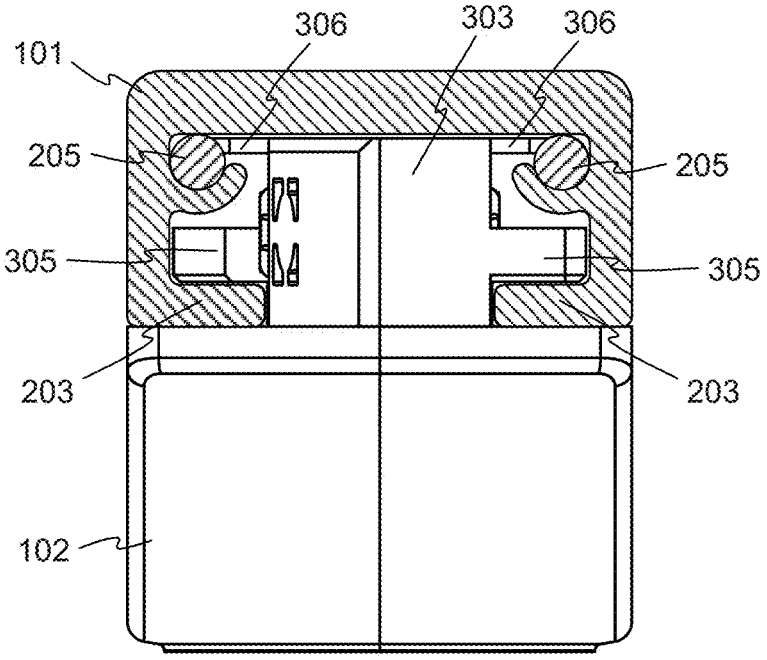
FIG. 9 shows an orthogonal end view of the assembly of FIG. 8, with added crosshatching for enhanced readability.

FIG. 9 shows an orthogonal end view of the completed assembly, with added crosshatching for enhanced readability. The head 303 resides within the track 101, while the hook features 305 have rotated outward to engage the ledges 203 of the track 101, to support the adapter 102 and any attached luminaire. The contacts 306 have rotated outward to engage the conductors 205 within the track 101.

Figure 10:
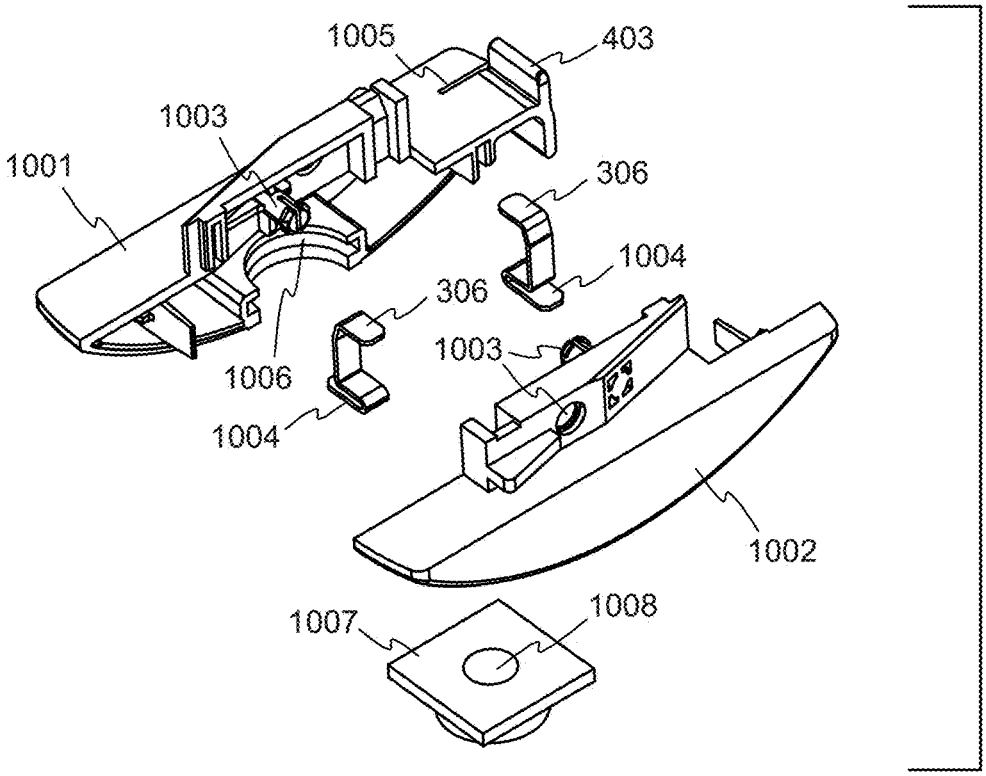
FIG. 10 shows an exploded upper oblique view of the adapter of FIG. 3, in accordance with embodiments of the invention.
Figure 11:
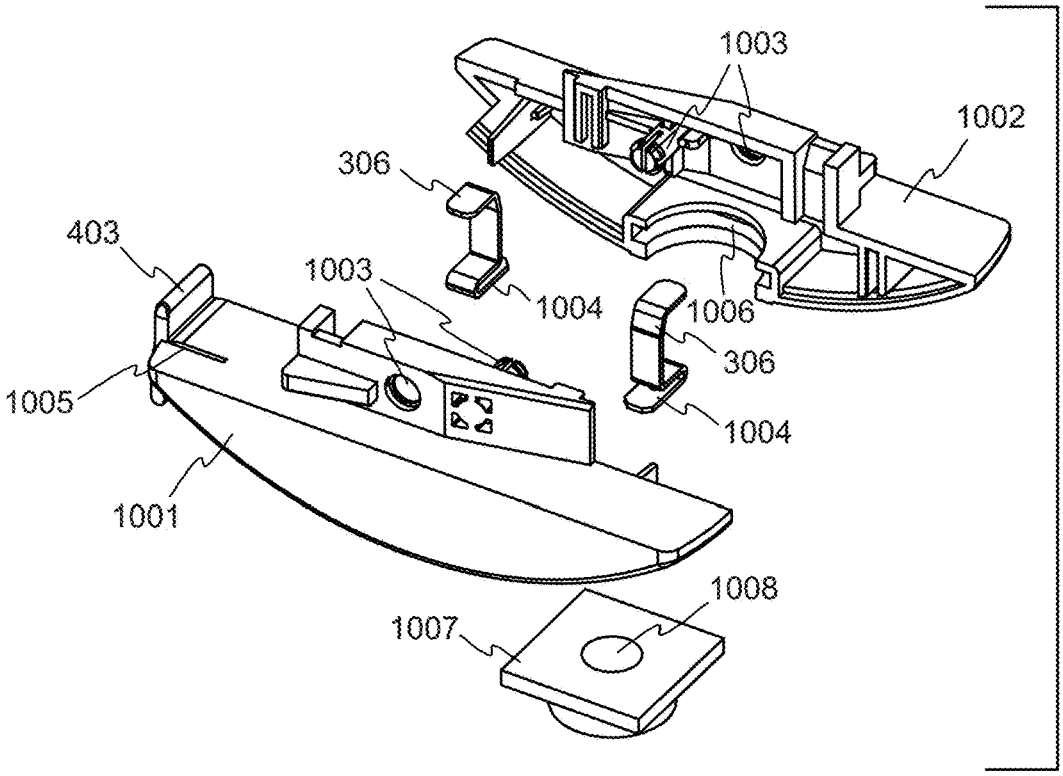
FIG. 11 shows another exploded upper oblique view of the adapter of FIG. 3, in accordance with embodiments of the invention.

FIG. 10 shows an exploded oblique view of the adapter 102, in accordance with embodiments of the invention, and FIG. 11 shows another exploded oblique view of the adapter 102. In the embodiments of FIGS. 10 and 11, the adapter 102 is formed from two pieces 1001 and 1002 that fit together in clamshell fashion to make up the body of the adapter 102. The two pieces 1001 and 1002 may snap together using snap features 1003. In other embodiments, the adapter 102 may be assembled using fasteners such as screws or bolts, or may be assembled in some other way.

The contacts 306 may be captured between the two pieces 1001 and 1002 of the adapter 102 body. In addition, the contacts 306 may include lower tabs 1004 suitable for spade-type push-on wire connectors or another kind of connector, for facilitating making electrical connections during installation of a luminaire to the adapter 102.

In some embodiments, the latch 403 may be integrally formed with one of the pieces 1001 or 1002 of the adapter 102 body. For example, the pieces 1001 and 1002 of the adapter 102 body may be injection molded from a polymer such as ABS, polycarbonate, or another polymer or a blend of polymers. The latch 403 may be deflectable at least in part by virtue of the flexibility of the material of the adapter 102 body. Geometric features such as slot 1005 may also be provided for enhancing the deflectability of the latch 403. In other embodiments, the latch may be a separate part, and a spring may be provided to bias the latch into the track.

In some embodiments, the adapter 102 may define a pocket 1006 for retaining a pivot bushing 1007. In the example embodiment shown, the pocket 1006 formed by the two pieces 1001 and 1002 of the adapter 102 is generally square, and the pivot bushing 1007 has a square portion sized to fit within the square pocket. This arrangement prevents rotation of the pivot bushing 1007 once the adapter 102 is assembled. An opening 1008 allows wiring to pass through the pivot bushing 1007 to reach the attached luminaire. With some kinds of luminaires, the pivot bushing 1007 may facilitate rotation of the luminaire with respect to the rest of the adapter 102.

Figure 12:
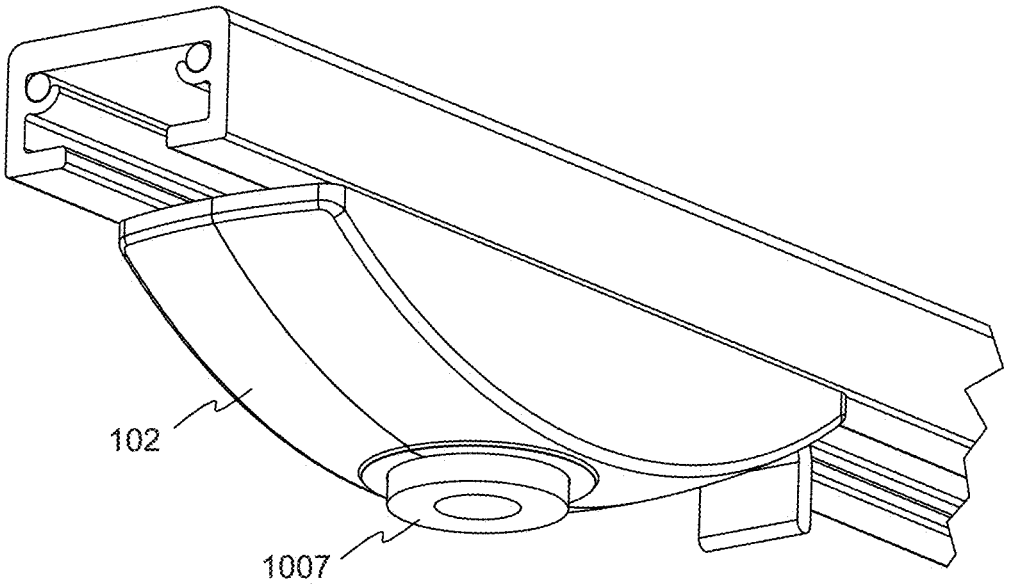
FIG. 12 shows the adapter of FIG. 3 with a pivot bushing installed, in accordance with embodiments of the invention.

FIG. 12 shows the adapter 102 with the pivot bushing 1007 installed.

The invention has now been described in detail for the purposes of clarity and understanding. However, those skilled in the art will appreciate that certain changes and modifications may be practiced within the scope of the appended claims.

What is claimed is:

1. An adapter for mounting a luminaire to a track of a track lighting system, the adapter comprising:

a main body having a first side configured to be installed toward the track, the main body having a longitudinal axis and a width measured transverse to the longitudinal axis of the main body, the main body also having a second side opposite the first, the second side including a feature for attachment of a luminaire;

a head extending from the first side of the main body, the head having a longitudinal axis and a width measured transverse to the longitudinal axis of the head, wherein the width of the head is smaller than the width of the main body and the head is of a shape and size to be inserted into the track when the longitudinal axis of the head is parallel to the track, and wherein the longitudinal axis of the head is angled by less than 70 degrees with respect to the longitudinal axis of the main body;

two hook features on the head positioned to engage the track when the adapter is installed to the track with the longitudinal axis of the main body parallel to the track; and two electrical contacts extending from the head, the contacts being of a shape and size to contact conductors in the track when the adapter is installed to the track with the longitudinal axis of the main body parallel to the track;

wherein the adapter is installable to the track by inserting the head into the track with the longitudinal axis of the head parallel to the track and subsequently turning the adapter such that the longitudinal axis of the main body is parallel to the track, and wherein the adapter further comprises a deflectable latch that engages the track to hold the longitudinal axis of the main body parallel to the track after installation.

2. An adapter and track combination, comprising:

the adapter of claim 1 with the track.

3. An adapter and luminaire combination, comprising:

the luminaire mounted to the adapter of claim 1.

4. The adapter of claim 1, wherein the latch is integrally formed with a housing of the adapter, and is deflectable at least in part by virtue of the flexibility of the material of the housing and latch.

5. The adapter of claim 1, wherein the main body and the head are formed from two pieces that fit together in a clamshell fashion and snap together, capturing the two electrical contacts.

6. The adapter of claim 1, wherein the longitudinal axis of the head is angled by less than 45 degrees with respect to the longitudinal axis of the main body.

7. The adapter of claim 1, wherein the longitudinal axis of the head is angled by less than 30 degrees with respect to the longitudinal axis of the main body.

8. The adapter of claim 1, wherein the longitudinal axis of the head is angled by less than 15 degrees with respect to the longitudinal axis of the main body.

9. The adapter of claim 5, further comprising a pivot bushing installed at the second side of the adapter, the pivot bushing being captured by the two pieces.

10. The adapter of claim 9, wherein the pivot bushing is prevented by the two pieces from rotation with respect to the main body.

11. A method of installing an adapter to a track in a track lighting system, the method comprising:

providing an adapter, the adapter comprising 1) a main body having a first side configured to be installed toward the track, the main body having a longitudinal axis and a width measured transverse to the longitudinal axis of the main body, the main body also having a second side opposite the first, the second side including a feature for attachment of a luminaire; 2) a head extending from the first side of the main body, the head having a longitudinal axis and a width measured transverse to the longitudinal axis of the head, wherein the width of the head is smaller than the width of the main body; 3) two hook features on the head; and 4) two electrical contacts extending from the head;

aligning the longitudinal axis of the head parallel to the track;

inserting the head into the track; and rotating the adapter less than 70 degrees to bring the longitudinal axis of the main body into parallelism with the track, at the same time bringing the hook features into engagement with the track and the electrical contacts into contact with conductors in the track.

12. The method of claim 11, further comprising deflecting a latch before rotating the adapter to bring the longitudinal axis of the main body into parallelism with the track.

13. The method of claim 11, wherein the adapter is rotated less than 45 degrees to bring the longitudinal axis of the main body into parallelism with the track.

14. The method of claim 11, wherein the adapter is rotated less than 30 degrees to bring the longitudinal axis of the main body into parallelism with the track.

15. The method of claim 11, wherein the adapter is rotated less than 15 degrees to bring the longitudinal axis of the main body into parallelism with the track.

16. A track lighting system, comprising:

a track having a generally C-shaped cross section and two ledges extending inward from two outer sides of the track, the track supporting two conductors in the track; and an adapter, wherein the adapter comprises:

a main body having a first side configured to be installed toward the track, the main body having a longitudinal axis and a width measured transverse to the longitudinal axis of the main body, the main body also having a second side opposite the first, the second side including a feature for attachment of a luminaire;

a head extending from the first side of the main body, the head having a longitudinal axis and a width measured transverse to the longitudinal axis of the head, wherein the width of the head is smaller than the width of the main body and the head is of a shape and size to be inserted into the track when the longitudinal axis of the head is parallel to the track, and wherein the longitudinal axis of the head is angled by less than 70 degrees with respect to the longitudinal axis of the main body;

two hook features on the head positioned to engage the ledges of the track when the adapter is installed to the track with the longitudinal axis of the main body parallel to the track; and two electrical contacts extending from the head, the contacts being of a shape and size to contact conductors in the track when the adapter is installed to the track with the longitudinal axis of the main body parallel to the track;

wherein the adapter is installable to the track by inserting the head into the track with the longitudinal axis of the head parallel to the track and subsequently turning the adapter such that the longitudinal axis of the main body is parallel to the track, and wherein the adapter further comprises a deflectable latch that engages the track to hold the longitudinal axis of the main body parallel to the track after installation.

17. The lighting system of claim 16, further comprising a luminaire attached to the adapter such that the luminaire is supported by the track and the adapter and draws power from the two conductors in the track.

18. The lighting system of claim 16, wherein each of the two hook features engages its respective ledge by at least 15 percent of the overall width of the track.

* * * * *